US006256793B1

(12) United States Patent
Arias et al.

(10) Patent No.: US 6,256,793 B1
(45) Date of Patent: Jul. 10, 2001

(54) CHAIN SCARF FASHION ACCESSORY AND METHOD OF MANUFACTURE

(76) Inventors: Gina R. Arias; Joy Robinson, both of 1395 Harbor Dr., Sarasota, FL (US) 34239

( * ) Notice: Subject to any disclaimer, the term of this patent is extended or adjusted under 35 U.S.C. 154(b) by 0 days.

(21) Appl. No.: 09/650,321

(22) Filed: Aug. 29, 2000

(51) Int. Cl.[7] ..... A42B 5/00

(52) U.S. Cl. ..... 2/207; 2/321; 63/3

(58) Field of Search ..... 2/206, 279, 207, 2/146, 153, 313, 321; D11/3; 63/3, 3.1, 4, 12, 38, 1.11

(56) References Cited

U.S. PATENT DOCUMENTS

| | | | | |
|---|---|---|---|---|
| D. 290,904 | | 7/1987 | Crouch . | |
| 3,748,661 | * | 7/1973 | Smith | 2/207 |
| 4,038,724 | * | 8/1977 | Parizek | 24/49 |
| 4,173,793 | | 11/1979 | Kazuo . | |
| 4,321,709 | * | 3/1982 | Steinberg | 2/207 |
| 4,788,722 | * | 12/1988 | Oliver | 2/207 |
| 5,643,643 | * | 7/1997 | Bernstein | 428/5 |
| 5,720,049 | * | 2/1998 | Clutton | 2/207 |

* cited by examiner

*Primary Examiner*—John J. Calvert
*Assistant Examiner*—Katherine Moran
(74) *Attorney, Agent, or Firm*—Dorothy S. Morse

(57) ABSTRACT

A decorative clothing accessory and a method for its manufacture, that comprises both scarf-like and jewelry components, and which can be worn comfortably even by those who are sensitive to and unable to tolerate clothing that is worn close against the neck, such as turtleneck shirts and sweaters, bandanas, and scarves. The present invention comprises an elongated flexible scarf-like member that is worn against the front and sides of a person's neck and a jewelry member with fastening means that draws the scarf-like member around to the back of the wearer's neck and secures it into its usable position. The back of the scarf-like member must feel soft against the neck, and include a soft fabric lining when necessary. Also, it is preferred that the jewelry member be adjustable and in the most preferred embodiment the jewelry member would comprise opposing chain segments of unequal length, which have large links and a toggle attached to the shorter chain segment. Decorative embellishments for the scarf-like member may include, but are not limited to, beads, pearls, embroidery, appliqués, reflective objects, gemstones, rhinestones, fringe, lace, medallions, small chains, teardrop-shaped objects, and decorative trim. Although not limited thereto, the shape of the scarf-like member may be substantially rectangular, V-shaped, cowl-like, or have a subtle is lower dip that follows the curvature of a human neck. Applications may include the accessorizing of formal and career fashions, as well as casual use.

20 Claims, 4 Drawing Sheets

CHAIN SCARF FASHION ACCESSORY AND METHOD OF MANUFACTURE

BACKGROUND

1. Field of Invention

This invention relates to neck encircling fashion accessories, specifically to a decorative clothing accessory and a method for its manufacture, that comprises both scarf-like and jewelry components, and which can be worn comfortably around the lower and middle parts of the neck even by those who are otherwise unable to tolerate clothing that fits closely against the neck, such as turtleneck shirts and sweaters, bandanas, dickeys, and scarves. The present invention comprises an elongated flexible scarf-like member made from fabric or other material that is worn against the front and sides of a person's neck and a flexible jewelry component attached to the opposite ends of the scarf-like member, with adjustable fastening means that draws the scarf-like member around to the back of the wearer's neck and secures it comfortably into its usable position. For maximum user comfort, the two ends of the scarf-like member should preferably remain at a spaced-apart distance from one another of approximately two to three inches. The neck-engaging surface of the scarf-like member which is targeted for contact with the front of a neck should be soft, and include a soft fabric lining, such as silk, when necessary for wearer comfort. Since the jewelry component comprises an adjustable fastening means, one or two basic sizes of the present invention can be used to fit most adult necks. In a majority of the preferred embodiments, the jewelry component would comprise a two-part chain having segments of unequal length, with each segment configured to lay flat against a neck and having large links or rings with a height dimension nearly identical to that of the scarf-like member's opposite end to which it will become attached. However, even though a single two-part chain connection is preferred, multiple chain connections are also contemplated to support a single scarf-like member, to provide a design choice, to support scarf-like members having a greater height dimension, and to support scarf-like members made from heavier and/or bulkier materials, such as fur or leather. As a further design alternative, the jewelry component could comprise pearls, and gold or silver chain to which gemstones or rhinestones are attached. Also in a majority of the preferred embodiments, an elongated toggle fastener would be used as the adjustable fastening means, and each shorter chain segment would have such a toggle fastener attached to its distal end, the toggle being configured for easy insertion through any of the links on the opposing longer chain segment. Nevertheless, alternative fasteners, such as lobster claw fasteners, may also be used with the present invention as long as they are configured to lay flat against a neck, for easy fastening, and without sharp edges that can snag clothing or cause injury. It is also contemplated for the scarf-like member to comprise a wide variety of decorative embellishments, such as beads, pearls, rhinestones, embroidery, appliques, reflective decorations, small mirrors, small buttons, fringe, lace, medallions, crests, shields, small chains, teardrop-shaped objects, and decorative trim. Further, although not limited thereto, the shape of the scarf-like member would preferably be substantially rectangular, V-shaped, cowl-like, or have a lower dip that subtly follows the curvature of a human neck. Applications may include the accessorizing of formal and career fashions, as well as use with clothing appropriate for more casual occasions.

2. Description of Prior Art

Accessories are important to fashion. They are desirable as they can add color accents, color contrast, texture, and other decorative interest to clothing to create a coordinated and complete fashion statement. Neck adornment accessories are also effective for adding attractive and complementary color tones to a person's face, and can be used in advantageous ways to enhance facial features, hide neck imperfections, and complement unusual and dramatic hairstyles. Accessories providing neck adornment have traditionally been limited to jewelry, ribbons, bandanas, dickeys, and scarves. During their use, some of the prior art neck adornment devices, such as scarves and dickeys, rest against or drape about the lower part of a neck. Although they typically encircle a neck, they may or may not be closely held against the neck. Scarves are usually secured in place by opposing ends or corners being tied into a knot, at least one part thereof being fastened in place with a brooch or decorative pin, or opposing ends or corners being threaded through a piece of jewelry specifically configured for holding the opposed ends of a scarf. However, the disadvantage of large bandanas and scarves is that even when they are tied or pinned they can be quite bulky, and while they may be suitable for use with certain formal and/or career fashions, they often are inappropriate for use with more casual clothing. Dickeys also can be bulky and are often unsuited for use with more casual clothing.

Other prior art neck accessories are used to adorn the middle part of a neck and must be secured closely against a substantial portion of the neck circumference to prevent inadvertent downward slippage to the lower part of the neck during use. When close contact exists between a neck adornment device and the entire circumference of the neck, such as would occur when smaller scarves, ribbons, and bandanas are tied around a neck, it often creates an uncomfortable constricted feeling that can also be accompanied by a further unpleasant sensation of choking or gagging. When prior art neck adornment devices contemplated for use around the middle part of the neck are configured to encircle only a portion of a neck they must be rigid in construction and able to tightly grip the front, sides, and/or back of the neck. Although rigid neck adornment devices, such as C-shaped wire-like necklaces, may be comfortable when the person wearing it remains substantially still, when the wearer makes any type of neck twisting movement, the rigid necklace will not move in unison with the wearer and can provide unpleasant neck restricting sensations. While adornment around the middle portion of a neck is desirable for its fashion enhancing and face flattering effects, there is no known neck adornment device for wear around the middle portion of a neck that is non-bulky and sufficiently comfortable for extended use.

Further, while neck-encircling jewelry can add texture and decorative interest to clothing, it is generally limited in its contribution of color. Also, while ribbons, bandanas, dickeys, and scarves can add wonderful color accent and contrast to complete a fashion statement, scarves and dickeys are generally bulky and therefore limited in use, and neckencircling ribbons while not bulky must be held tightly against the middle part of a neck and are found by many to be too constricting for frequent or extended use. Therefore, it would be desirable, and it is not heretofore known to have a combination fashion accessory comprising both jewelry and scarf-like components which is easily adjustable so that one or two sizes can be comfortably worn around most adult necks, even by those who otherwise find turtleneck clothing and accessories secured against the neck too constricting for frequent or extended use, with the jewelry component providing texture and decorative interest needed to accessorize fashions and the scarf-like component providing color and additional texture interest.

The inventions thought to be most closely associated with the present invention are disclosed in U.S. Design Pat. No. D290904 to Crouch (1987) and U.S. Pat. No. 4,173,793 to Kazuo (1977). However, there are important differences between these two inventions and the present invention. The dickey shown in the Crouch invention appears from a front view to resemble the cowl-like embodiment of the present invention, but does not resemble any of the other embodiments of the present invention. Also, the Crouch invention appears to be longer than the present invention and to extend farther downward over the upper chest area adjacent to the neck. In addition, the Crouch invention appears to be bulkier than the present invention, and it completely encircles a neck with no jewelry component against the back of a neck to help prevent the neck constricting sensation produced by many devices positioned closely against a neck during use. Further, while the Kazuo invention comprises a wire, a hook, and a chain, components that are also used in the present invention, and while it is used with scarves, the Kazuo invention discloses a knot-retaining implement that helps to maintain knots formed in neck-encircling devices such as neckties and scarves from becoming loosened during use. The Kazuo invention does not function as a neck-encircling device. Also, while the Kazuo invention can be attached to a scarf near to its ends, it is detachably connected to a knot in the scarf and its chain is not directly stitched into the ends of a scarf or scarf-like member, as in the present invention, to help the scarf or scarf-like member encircle a neck and become positioned directly against it without the neck constricting sensation that often is felt by a wearer. No invention is known that has all of the features of the present invention.

SUMMARY OF INVENTION

Objectives and Advantages

The primary object of this invention is to provide a quickly attached and released lightweight neck-encircling fashion device that comprises both scarf-like and jewelry components for diversity in accessorizing formal and career clothing, as well as casual clothing. A further object of this invention is to provide a chain-scarf accessory that has soft fabric available for engagement with the front of a neck and is configured so that its scarf-like component covers only the front and sides of the wearer's neck, leaving the back of the neck adorned only by the jewelry component so that people who typically feel uncomfortable when wearing tight clothing around the neck will not experience an unpleasant neck constricting sensation when wearing the present invention. It is a further object of this invention to provide decorative embellishments for the chain-scarf accessory to enhance its versatility as a fashion accessory. It is also an object of this invention to provide an adjustable chain-scarf accessory that allows one or two sizes to fit most adult necks. A further object of this invention is to provide a chain-scarf accessory that has a configuration easily manufactured in a smaller size for children. It is also an object of this invention to provide a chain-scarf accessory with a fastener that lays flat against a neck and has a blunt configuration that will not snag clothing or cause injury. It is a further object of this invention to provide a chain-scarf accessory that is efficiently constructed, has durable construction, and is made from materials that require little or no maintenance between uses.

As described herein, properly manufactured and used, the present invention would provide a versatile chain-scarf fashion accessory that could be worn with formal and career fashions, as well as casual clothing, since it has a jewelry member used against the back of a neck and a flexible elongated scarf-like member for use against the front and sides of the neck, with at least the center portion of its neck-engaging back surface being made from soft fabric, such as silk. The scarf-like member can be made from a variety of materials to include simple, sheer, elegant and/or expensive fabrics, fur, and leather, as well as colorful fabrics with trend-setting patterns and textures, to provide a multitude of aesthetically pleasing, neck-enhancing, and face flattering fashion statements. If the material used for the scarf-like member is not soft or delicate, a lining could optionally provide the soft surface needed for contact with at least the front portion of a neck. Such lining could be detachable for laundering purposes. Also, where desired, the scarf-like member could be decoratively enhanced with permanently attached or detachable embellishments, such as pearls, beads, gemstones, rhinestones, sequins, appliques, embroidery, reflective decorations, chains, decorative trim, and the like. The scarf-like member can be wide or narrow in height dimension, and have a variety of configurations, to include but not be limited to, one that is substantially rectangular with top and bottom edges approximately parallel to one another, one that has a bottom edge with a convexly shaped lower dip configured for subtly following the curvature of a human neck, one having a V-shaped dip on its lower edge, and one having a draped cowl-shaped dip. To prevent a constricted feeling around the neck while it is being worn, both ends of the scarf-like member are attached to separate parts of a flexible jewelry component that are used to draw the scarf-like member toward the back of the wearer's neck. An adjustable fastener is then used to secure the scarf-like member comfortably into its non-slip usable position. Optimally, a spaced-apart distance would remain between the opposing ends of the scarf-like member during use. It is preferred that the jewelry member be adjustable so that one or two sizes of the present invention will fit most adult necks, and one smaller embodiment could be easily manufactured for most children. In the most preferred embodiment of the present invention the jewelry member would comprise two chain segments of unequal lengths, each having large links or rings comparable in size to the height dimension of the scarf-like member ends to which it will become attached, and a toggle attached to the shorter chain segment. The toggle would be configured for easy engagement and disengagement with any link in the longer section of chain to provide the adjustable connection desired. The toggle fastener would also be configured and attached to lie flat against a neck, and its blunt ends would prevent clothing snags and wearer injury. Other fasteners, such as a lobster claw fastener, are also considered to be within the scope of the present invention even though they might not be as readily fastened as a toggle fastener, as long as they do not possess sharp and pointed edges that could cause clothing damage or injury to the person wearing it. Exceptionally wide scarf-like members, and those made from bulkier materials, could utilize additional chain segments, such as two or three chain connections across the back of a neck instead of the single two-part chain connection more frequently used. Further, since it is contemplated for the raw edges of the fabric in the scarf-like member to be alternatively stitched to one another to make a hidden seam, be formed into a rolled hem, or otherwise manipulated and secured to prevent unraveling or fraying, and since the jewelry member is flexible and can optionally comprise a D-ring connector or similar connector device for securely joining the scarf-like and jewelry members so that they lie flat and comfortably against a neck during use, the chain-scarf accessory of the present invention would be worn comfortably for extended periods of time, and could be repeatedly used without visible signs of wear. It is also contemplated that the present invention would be made from fabric, jewelry, and decorative embellishments not adversely affected by dry cleaning products or periodic hand washing. It is also expected that materials selected for the chain scarf invention would require little maintenance or care between uses.

The description herein provides the preferred embodiments of the present invention but should not be construed as limiting the scope of the chain-scarf invention. For example, variations in the type, thickness, and configuration of the fabric used for the scarf-like member; the presence and shape of a lower dip on the scarf-like member; the number of chain attachment points at the back of the wearer's neck; the amount and placement of reinforcement stitching used on the scarf-like member; the type of adjustable fastening means used; the configuration of the chain-to-scarf connector used; the configuration of the pleats used on the scarf-like member with a cowl-shaped dip, and the number, type, and combination of embellishments used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
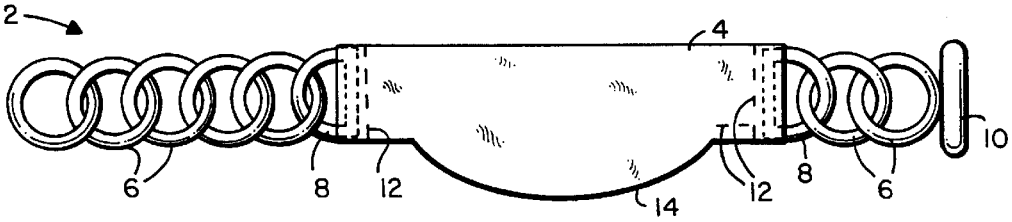
FIG. 1 is a back view of a first embodiment of the present invention having a scarf-like member with a subtle dip for following the curvature of a human neck, two chains each having large round links near in size to the height dimension of the ends of the scarf-like member, and a toggle fastener connected to the shorter chain, all assembled into a ready-towear configuration.
Figure 4:
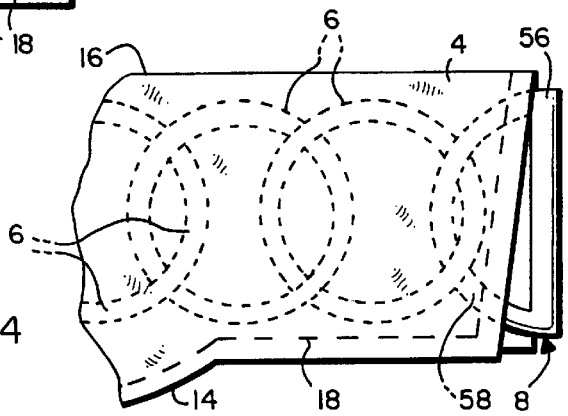
FIG. 4 is an enlarged perspective view of the material used for the scarf-like member in the first embodiment, folded in half with the right sides of the material facing one another prior to stitching, and with the D-ring connector and large chain links attached thereto positioned between the right sides of the material.
Figure 17:
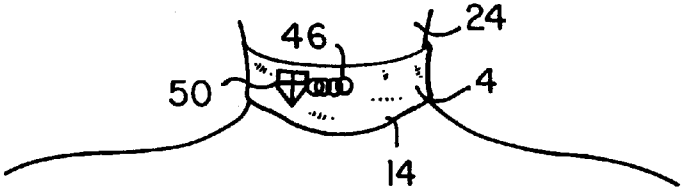
FIG. 17 is a front view of the first embodiment with a crest/shield embellishment, shown in its usable position on a neck.

FIG. 1 shows a first preferred embodiment 2 of the present chain scarf invention having an elongated scarf-like member 4 and a two-part jewelry member consisting of a longer segment of interconnected chain links or rings 6 attached to one end of scarf-like member 4 and a shorter second segment of interconnected chain links or rings 6 with a connected toggle fastener 10 being attached to the other end of scarf-like member 4. Although the height dimensions of scarf-like member 4 and chain links or rings 6 appear to be nearly the same and are in correct proportion to one another, scarf-like member 4 has been shortened to approximately half of its normal length relative to the length dimension of the interconnected chain links or rings 6 for illustrative purposes. The central portion of toggle fastener 10 is attached to the distal chain link or ring 6 on the shorter chain segment so that all of the chain links or rings 6 connected thereto are positioned between toggle fastener 10 and scarf-like member 4. As can be seen in FIG. 1, toggle fastener 10 has an elongated configuration and opposed blunt ends that are incapable of snagging fabric, or of causing injury to a person manipulating it or to the neck of the person wearing it. Toggle fastener 10 is also configured so that it can be fully inserted through one or more of the chain links or rings 6 attached to the other end of scarf-like member 4 remote from toggle fastener 10. Although any type of easy-to-use fastener allowing the first preferred embodiment 2 to be adjustably connected around a human neck is considered within the scope of the present invention, the preferred fastening means should also lay flat against the circumference of the neck and should be configured so as not to snag clothing or lay uncomfortably against the skin of the person wearing it. As also seen in FIG. 1, there is a greater number of chain links or rings 6 on the end of scarf-like member 4 remote from toggle fastener 10. This allows the adjustable connection that places toggle fastener 10 more centrally on the back of most necks during use, for a balanced and more aesthetically pleasing appearance, similar to that shown in FIG. 12. FIG. 1 further shows first preferred embodiment 2 having a D-ring connector 8 attached to each end of scarf-like member 4 as a means of attaching chain links or rings 6 to scarf-like member 4. D-ring connectors 8 can be made to interlink with chain links or rings 6, as shown in FIG. 1, or in the alternative to be bonded to the outside surface of the proximal chain link or ring 6, as long as the type of bonding agent (not shown) used provides a secure and durable connection. In addition, FIG. 1 shows two approximately parallel spaced-apart lines of reinforcement stitching 12 on scarf-like member 4, one adjacent to each D-ring connector 8, which extend the full height dimension of scarf-like member 4. Also, each line of reinforcement stitching 12 is positioned between a subtle convexly-shaped dip 14 on the lower edge of scarf-like member 4 and a different one of the opposed ends of scarf-like member 4, with the adjacent D-ring connector 8 positioned laterally to reinforcement stitching 12. The addition of reinforcement stitching 12 helps to strengthen the ends of scarf-like member 4 and to maintain each D-ring connector 8 in its optimal position during use. FIG. 1 also shows a short quantity of reinforcement stitching 12 along the lower edge of scarf-like member 4 between one of the longer parallel lines of reinforcement stitching 12 and subtle dip 14. The short quantity of reinforcement stitching 12 on the lower edge is used to seal an opening (not shown), when one is employed during manufacture for turning scarf-like member 4 right-side-out after the right sides of scarf-like member 4 are made to face one another and one or more D-ring connectors 8 are stitched into each end of scarf-like member 4, as shown in FIG. 4. FIG. 1 also shows subtle dip 14 centered on the lower edge of scarf-like member 4, which is configured to follow the curvature on the front of the wearer's neck, as shown in FIG. 17, and allow scarf-like member 4 of medium height dimension to more easily lay flat against the neck. Although not critical to the first preferred embodiment 2, FIG. 1 shows the upper edge of scarf-like member 4 having a substantially straight and unadorned configuration. Although a straight configuration is preferred, it is also considered within the scope of the present invention for scarf-like member 4 to have other upper edge configurations, including those that are arcuate and angled.

Although not shown in FIG. 1, and not limited to the following, it is contemplated for first preferred embodiment 2 having subtle dip 14 to be made from thin, soft, lightweight fabrics such as silk, polyester, linen, rayon, and chiffon. However, embodiments having a subtle dip 14 could also be made from other fabrics, including those having a more substantial thickness dimension, such as but not limited to cashmere, faux fur, and mink. When thicker fabrics and materials are used and where necessary for the comfort of the person wearing it, a soft lining, such as lining 32 shown in FIG. 7, could be permanently or detachably connected to the neck-engaging back surface of scarf-like member 4. Such lining 32 could extend across the entire back surface of scarf-like member 4, or in the alternative be only attached to the portion of scarf-like member 4 anticipated for direct contact with the front of a neck. Also, although not shown, fasteners such as snaps or hook-and-loop fasteners could be used to allow detachable connection of lining 32 to the remainder of scarf-like member 4 for laundering purposes. Similar to the use of lining 32, an additional layer of fabric (not shown) could be secured between the front and back surfaces of scarf-like member 4 to provide color contrast or support when scarf-like member 4 is made from sheer fabrics. This additional layer could be attached to scarf-like member 4 prior to the stitching of chain links or rings 6 and D-ring connectors to scarf-like member 4, or simultaneously with such stitching. Further, although not limited to such dimension, for most purposes first preferred embodiment 2 having subtle dip 14 would have a scarf-like member 4 with a length dimension of approximately ten-and-one-half inches. The corresponding height dimensions of scarf-like member 4 at each of its ends would be approximately three-fourths of an inch, and scarf-like member 4 would have a central height dimension of approximately two-and-one-half inches. Although other sizes of chain links or rings 6 are considered within the scope of the present invention, as well as the use of four or six segments of chain links or rings 6 with a corresponding increase in the number of D-ring connectors 8 being used to pull the ends of scarf-like member 4 toward the back of a human neck, in the jewelry component of first preferred embodiment 2 for most purposes it is preferred that only two segments of chain links or rings 6 be used and for each chain link or ring 6 to have a height dimension of approximately three-fourths of an inch, the same height dimension as the ends of scarf-like member 4. The configuration of chain links or rings 6 is not critical and in addition to the round configuration shown in FIG. 1, it is also contemplated for chain links or rings 6 to have other configurations, such as elongated or oval. Also in first preferred embodiment 2, the longer connected segment of chain links or rings 6 attached to scarf-like member 4 for most purposes would have a maximum length dimension of approximately three inches. Further, in first preferred embodiment 2, to provide the versatility of being able to offer less expensive embodiments for casual use, as well as more expensive embodiments for career and formal use, toggle fastener 10 could be made from gold, silver, a combination gold and silver, gold-filled materials, gold plated materials, silver plated materials, and other non-tarnishing materials resembling gold and silver, with chain links or rings 6 being made from the same materials as well as pearls, gemstones, and rhinestones. Decorative embellishments for the first preferred embodiment 2 of the chain scarf invention could include fringe, appliques, patches, pearls, beads, sequins, gemstones, rhinestones, small buttons, embroidery, lace, reflective decorations, small mirrors, medallions, crests, shields, small chains, teardrop-shaped objects, decorative trim, and the like. In addition, although not limited thereto, in first preferred embodiment 2 and for maximum comfort of the person wearing it, the optimum spaced-apart distance between the ends of scarf-like member 4 while it encircles a neck would be approximately two to three inches.

Figure 2:
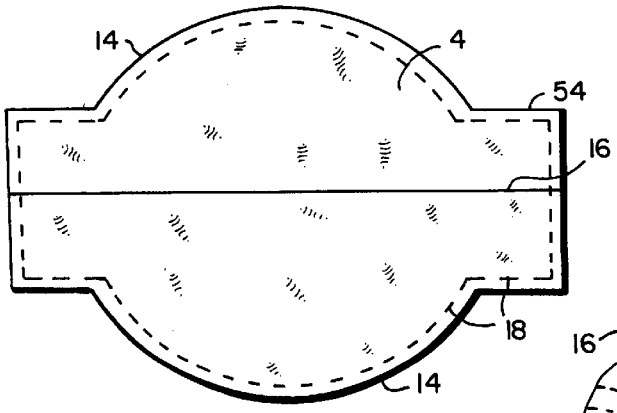
FIG. 2 is a top view of the material used for the scarf-like member of the first embodiment, unfolded and in a ready-to-sew configuration.

FIG. 2 shows an example of the unfolded configuration of a scarf-like member 4 used for one-piece construction of the first embodiment 2 of the present invention. FIG. 2 shows scarf-like member 4 having a central longitudinal fold line 16 with the quantity of fabric on each side of fold line 16 being approximately equal in size and a mirror image of the other. A subtle dip 14 extends centrally upward from the upper perimeter edge 54 of scarf-like member 4, while a similar lower subtle dip 14 extends centrally downward from the lower perimeter edge 54 of scarf-like member 4. FIG. 2 also shows a seam line 18 used for stitching the mirror image portions of scarf-like member 4 to one another after folding is achieved along fold line 16. Stitching could occur with the right sides of the material used for scarf-like member 4 facing one another, after which the material of scarf-like member 4 would be turned right-side-out, with the opening used for turning scarf-like member 4 top stitched or blind stitched for closure. In the alternative, the material used for scarf-like member 4 could be stitched with its right sides facing away from one another and the edges of the material folded at seam lines 18 so that they remain between the two folded portions of scarf-like member 4, after which, since the right sides of scarf-like member 4 already face away from one another there would be no need to turn scarf-like member 4 right-side-out, and no opening would need to be sealed. In the most preferred embodiment, although not limited thereto, the seam line 18 is positioned a minimum distance of one-fourth of an inch from perimeter edge 54 and a maximum distance of five-eighths of an inch from perimeter edge 54. Although not shown, depending upon the type of fabric used for scarf-like member 4, the stitching used for seam line 18 can comprise straight stitching, zig-zag stitching, or both, with zig-zag stitching being used on more delicate and loosely woven fabrics. As an alternative to one-piece construction, chain scarf invention 2 can be made from two pieces of fabric, each slightly larger in size than the fabric pieces that would result from cutting scarf-like member 4 along fold line 16. Three-piece construction could result from a third piece of fabric (not shown) being added as a soft lining for the neck-engaging back surface of scarf-like member 4, similar to lining 32 in FIG. 7, or when a third piece of fabric is added for color accent to embodiments of the present invention where at least one of the pieces of scarf-like member 4 is partially transparent or sheer.

Figure 3:
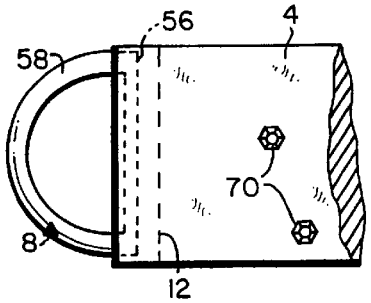
FIG. 3 is an enlarged front view of one of the D-ring connectors used for chain-to-scarf connection in the first embodiment of the present invention and being stitched into its usable position between opposed folded parts of the scarf-like member.

FIGS. 3 and 4 show the attachment of D-ring connector 8 to one end of scarf-like member 4. FIG. 3 also shows the attachment of sequins 70 to scarf-like member 4. FIG. 3 shows D-ring connector 8 after attachment to scarf-like member 4, while FIG. 4 shows the rights sides of scarf-like member 4 facing one another, with D-ring connector 8 positioned therebetween and ready for attachment to scarf-like member 4. In FIG. 3, the right sides of scarf-like member 4 face away from one another, with the straight bar member 56 of D-ring connector 8 being hidden and secured between the two opposing surfaces of folded scarf-like member 4, and the C-shaped arcuate member 58 of D-ring connector 8 extending beyond the end of scarf-like member 4. Stitching 12 helps to reinforce the end of scarf-like member 4 and form a pocket within which straight bar member 56 is maintained during use. Stitching should be placed near to scarf-like member 4 to form a small end pocket so that a maximum amount of C-shaped arcuate member 58 will remain continuously exposed beyond the end of scarf-like member 4 during use. FIG. 4 shows chain links or rings 6 attached to one another to form an elongated interconnected segment of chain, and one end thereof connected to the C-shaped arcuate member 58 of D-ring connector 8. Scarf-like member 4 is folded in half along fold line 16, with right sides together, and D-ring connector 8 is positioned relative to scarf-like member 4 with straight bar member 56 extending beyond the end of scarf-like member 4 and approximately parallel to it. The C-shaped arcuate member 58 of D-ring connector 8 is positioned between the folded halves of scarf-like member 4 where it will remain while the folded halves of scarf-like member 4 are stitched to one another along seam line 18. During one preferred method of construction for chain scarf invention 2, seam line 18 extends along the entire perimeter of the material used for scarf-like member 4 and while the right sides of the material are in contact with one another, a majority of seam line 18 is stitched except one small portion that is used to turn scarf-like member 4 right-side-out and expose chain links or rings 6 so that they can be used to attach scarf-like member 4 around a human neck. Once scarf-like member 4 has been turned right-side-out, the remaining unstitched part of seam line 18 will be closed with top stitching or blind stitching (not shown), preferably with thread having a color closely matching that of the material used for scarf-like member 4. Although not limited thereto, the part of scarf-like member 4 left open for fabric reversal would preferably be positioned on the lower edge of scarf-like member 4 between one of its ends and subtle dip 14.

Figure 5:
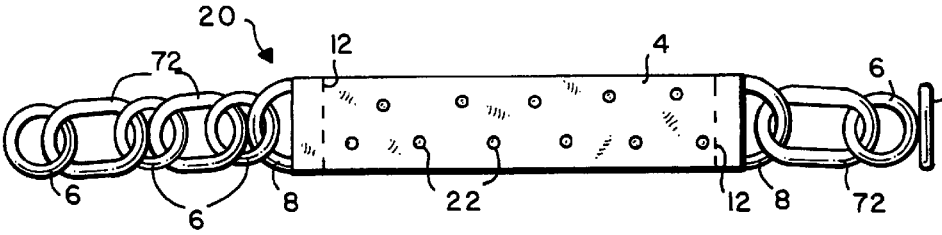
FIG. 5 is a front view of a second embodiment of the present invention having a scarf-like member with no dip, reinforcement stitching adjacent to the D-ring connector, and bead/pearl embellishment, in a ready-to-wear configuration.

FIG. 5 shows a second embodiment 20 of the present invention having an elongated scarf-like member 4 with opposing top and bottom edges approximately parallel to one another in place of a subtle lower dip 14. Second embodiment also has a two-part jewelry member consisting of a longer segment of interconnected chain links or rings 6, as well as segment having one interconnected chain link or ring 6, one elongated chain link 72, and a toggle fastener 10 attached to the other end of scarf-like member 4. Toggle fastener 10 is attached to one chain link or ring 6 so that the chain links or rings 6 and elongated chain links 72 connected to it are positioned between toggle fastener 10 and one end of scarf-like member 4. Toggle fastener 10 is elongated and connected centrally to the distal chain link or ring 6 on the shorter segment of interconnected chain links or rings 6 and elongated chain links 72, and is also configured in proportion to the opposed chain links or rings 6 and elongated chain links 72 attached to the other end of scarf-like member 4 remote from toggle fastener 10 so that it can be fully inserted through one or more of them. Any type of fastener allowing second embodiment 20 to be adjustably connected around a neck is considered within the scope of the present invention. Also, such fasteners should lay flat against the circumference of the neck and be configured bluntly so as not to snag clothing or lay uncomfortably against the skin of the person wearing it. As can be seen in FIG. 5, there are more chain links or rings 6 and elongated chain links 72 on the end of scarf-like member 4 remote from toggle fastener 10. This allows toggle fastener 10 to become more centrally located on the back of most necks during use, for a balanced and more aesthetically pleasing appearance, similar to that shown in FIG. 12. FIG. 5 further shows chain scarf invention 2 having a D-ring connector 8 attached to each end of scarf-like member 4 as a means of connecting chain links or rings 6 and elongated chain links 72 to scarf-like member 4. D-ring connectors 8 can be made to interlink with chain links or rings 6 and elongated chain links 72, or in the alternative to be bonded to the outside surface of the proximal chain link or ring 6 and elongated chain links 72. In addition FIG. 5 shows reinforcement stitching 12 adjacent to each D-ring connector 8. The use of a D-shaped connector 8, while preferred, is not critical. No other stitching 12 is shown in FIG. 5 perpendicular to the reinforcement stitching 12 adjacent to D-ring connector 8 that would be used for sealing an opening employed for turning scarf-like member 4 right-side-out after securing D-ring connectors 8 within its end. In the second preferred embodiment 20, although not shown in FIG. 5, blind stitching that would not be visible from the front side of the present invention, could be used to close the opening left open for fabric reversal, or in the alternative, a short length of stitching 12 could be placed anywhere along the top or bottom edges of scarf-like member 4, preferably on the bottom edge where it would be less likely to be noticed by a casual observer. FIG. 5 further shows decorative embellishments 22 attached in an aesthetically pleasing array to the front surface of scarf-like member 4. It is contemplated that embellishments 22 could comprise pearls, beads, gemstones, rhinestones, small chains, lace, decorative trim, small buttons, patches, sequins, reflective decorations, appliqués, and the like.

Figure 13:
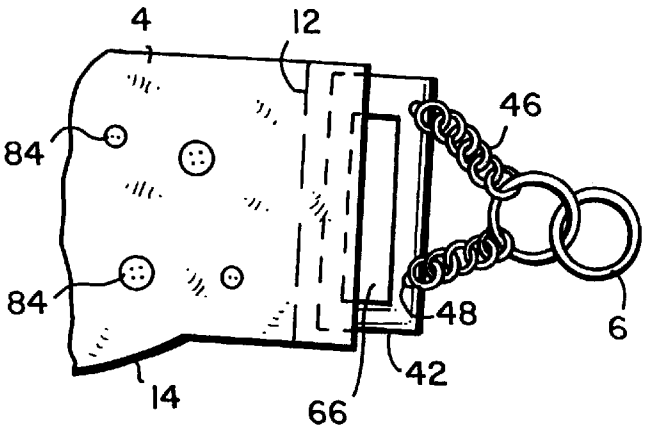
FIG. 13 is an enlarged view of a rectangular-shaped connector used in the present invention and providing a two-point chain attachment for use with scarf-like members having a greater height dimension.
Figure 15:
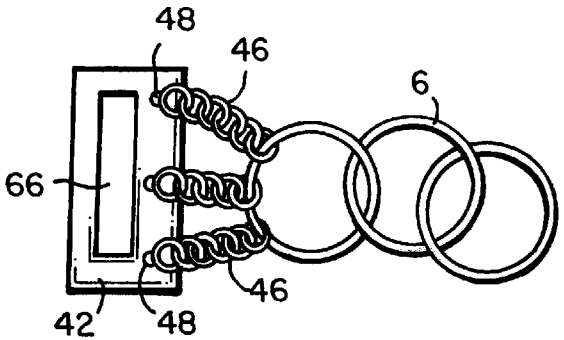
FIG. 15 is an enlarged view of a rectangular-shaped connector used in the present invention and having a three-point chain attachment for use with scarf-like members having a greater height dimension, or made from bulkier material
Figure 14:
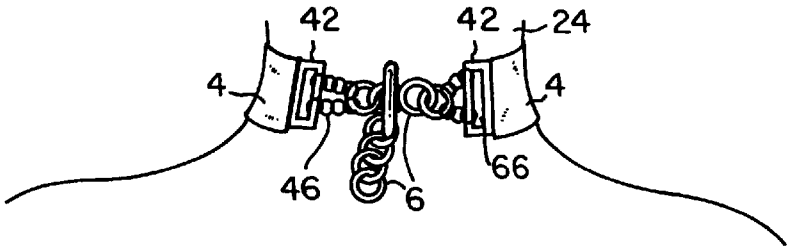
FIG. 14 is a back view of the present invention shown on a neck, with a rectangular-shaped connector for chain-to-scarf connection, and a two-point chain attachment.

Although not shown in FIG. 5, and not limited thereto, it is contemplated for second preferred embodiment 20 to be made from fabrics and materials that are heavier than would be typically used for first preferred embodiment 2, such as but not limited to, cashmere, faux fur, wool, suede, leather, denim, velvet, quilted materials, and mink. Also, in second preferred embodiment 20 scarf-like member 4 would have a length dimension of approximately eleven inches, instead of the ten-and-one-half inch preferred length for first preferred embodiment 2. The corresponding height dimension of scarf-like member 4 would be approximately three-and-one-half inches. Since second preferred embodiment 20 is made from heavier and/or bulkier fabrics, it would preferably comprise a soft lining material, such as lining 32 shown in FIG. 7. Lining 32 could be detachably connected to scarf-like member 4 for laundering purposes. At a minimum lining 32 should be located centrally on the back surface of scarf-like member 4 where contact with the front of neck 24 is expected, however, lining 32 could extend the full length and height dimensions of scarf-like member 4. If detachably connected to scarf-like member 4, although not shown, lining 32 could comprise a plurality of snaps, hook-and-loop fasteners, or other means of connection that would not interfere with the comfort of a person having it in close contact with the neck. One contemplated fabric for lining 32, although not limited thereto, is silk. Also, to support the heavier and bulkier fabrics and materials used in second preferred embodiment 20, it is contemplated that instead of using one segment of chain links or rings 6 on each end of scarf-like member 4, although not shown, multiple segments of chain links or rings 6 could be attached to the ends of scarf-like member 4 with one or more D-ring connectors 8, or two or three small chain segments 46 could be employed on each side of scarf-like member 4 for enhanced support, as shown in FIGS. 13–15. When small chain segments 46 are used, they could all interconnect with the proximal chain link or ring 6, or the outer chain links or rings 6 and elongated chain links 72 could connect with other chain links or rings 6 and elongated chain links 72 on the same end of scarf-like member 4. Also, in second preferred embodiment 20, the width dimension of chains links or rings 6, elongated chain links 72, and the materials from which chain links or rings 6, elongated chain links 72, and toggle fastener 10 are made would be similar to that proposed for chain scarf invention 2 having subtle dip 14, so that less expensive embodiments could be offered for casual use, as well as more expensive embodiments for career and formal use.

Figure 6:
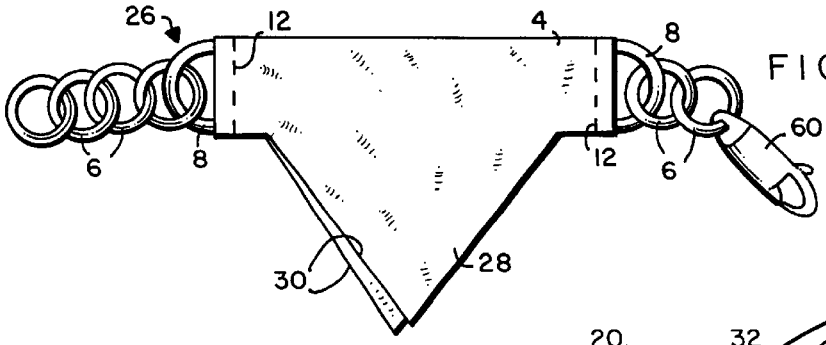
FIG. 6 is a back view of a third embodiment of the present invention having a scarf-like member with a V-shaped dip, a lobster claw fastener, and a rolled hem, in a ready-to-wear configuration.
Figure 19:
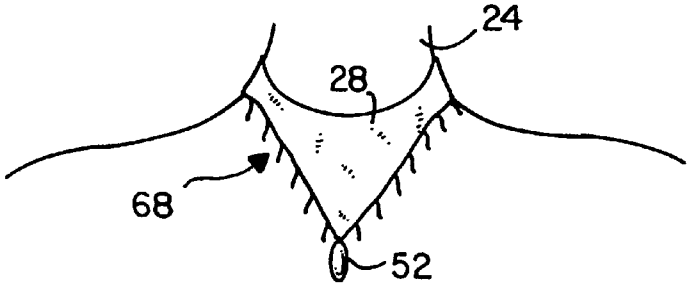
FIG. 19 is a front view of the third embodiment with fringe and a centered teardrop-shaped embellishment, shown in its usable position on a neck.

FIG. 6 shows a third preferred embodiment 26 of the present invention having an elongated scarf-like member 4 with a V-shaped dip 28 and a two-part jewelry member consisting of a longer segment of interconnected chain links or rings 6 attached to one end of scarf-like member 4 and a shorter second segment of interconnected chain links or rings 6 with a lobster claw fastener 60 attached to the other end of scarf-like member 4. Lobster claw fastener 60 is attached to the distal chain link or ring 6 on the shorter chain segment so that the chain links or rings 6 connected to it are positioned between lobster claw fastener 60 and scarf-like member 4. Although any type of fastener allowing third embodiment 26 to be adjustably connected around a human neck is considered within the scope of the present invention, in the third preferred embodiment 26 the fastening means would lay flat against the circumference of the neck and be configured so as not to snag clothing or lay uncomfortably against the skin of the person wearing it. The additional chain links or rings 6 on the end of scarf-like member 4 remote from lobster claw fastener 60 allow lobster claw fastener 60 to become more centrally located on the back of most necks during use, for a balanced and more aesthetically pleasing appearance, similar to that visible in FIG. 12. FIG. 6 further shows third embodiment 26 having a D-ring connector 8 attached to each end of scarf-like member 4 as a means of connecting chain links or rings 6 to scarf-like member 4. The use of D-shaped connector 8 is not critical and it is considered within the scope of the present invention for other chain-to-scarf connectors to be used, including rectangular-shaped connector 42, shown in FIGS. 13–15. In addition FIG. 6 shows two approximately parallel spaced-apart lines of reinforcement stitching 12 each adjacent to a different one of the D-ring connectors 8 to keep it in a substantially exposed and fixed position during use. FIG. 6 also shows V-shaped dip 28 centered on the lower edge of scarf-like member 4, with the lower edges of V-shaped dip 28 each independently formed into a very narrow rolled hem 30 instead of being stitched to one another with a hidden seam used in first preferred embodiment 2 and second preferred embodiment 26 to keep the cut edges of the material used for scarf-like member 4 from the type of incidental contact that would eventually cause it to have an undesirable tattered or worn appearance. Although not shown in FIG. 6, but similar to the seam line 18 shown in FIG. 10 and the shorter segment of reinforcement stitching 12 shown in FIG. 1, two shorter segments of reinforcement stitching 12 could be added to scarf-like member 4, each adjacent to a different one of the parallel lines of reinforcement stitching 12 and in a position approximately perpendicular thereto for strengthening scarf-like member 4 near its attachment to D-ring connectors 8. It is contemplated for lobster claw fastener 60 and a chain link or ring 6 on the opposing jewelry component attached to scarf-like member 4 to be connected about the middle part of a neck 24, similar to the position shown in FIG. 12, with V-shaped dip 28 covering the lower front portion of a human neck and the upper central portion of the wearer's chest adjacent to the neck, as shown in FIG. 19. Although not critical to the present invention, FIG. 6 shows the upper edge of scarf-like member 4 to have a substantially straight and unadorned configuration.

Although not shown in FIG. 6, and not limited thereto, it is contemplated for third preferred embodiment 26 of chain scarf invention having V-shaped dip 28 to be made from thin, soft, and lightweight fabrics, although some medium weight fabrics would also be suitable. When thicker fabrics and materials are used, and where necessary for the comfort of the person wearing it, a soft lining material, such as lining 32 shown in FIG. 7, could be attached to the back surface of scarf-like member 4. Lining 32 could be permanently attached to scarf-like member 4, or detachably connected to it with easily engaged fasteners, such as snaps or hook-and-loop fasteners (not shown). Also, lining 32 could be small in dimension and be used only for the neck-engaging back surface in direct contact with the front of a neck, or lining 32 could be larger and extend the full length or height of scarf-like member 4, or both. Although not limited thereto, in third preferred embodiment 26, the length dimension of scarf-like member 4 would be approximately eleven inches. The corresponding maximum height dimension of scarf-like member 4 having a V-shaped dip 28 would approximately six inches. Although other sizes of chain links or rings 6 are considered within the scope of the present invention, in the corresponding jewelry component it is preferred that chain links or rings 6 each have a height dimension of approximately three-fourths of an inch, the same height dimension as the ends of scarf-like member 4, and for the longer connected segment of chain links or rings 6 to be approximately three inches in length. In third preferred embodiment 26, chain links or rings 6 and lobster claw fastener 60 would be made from gold, silver, a combination gold and silver, gold-filled materials, gold plated materials, silver plated materials, and other non-tarnishing materials resembling gold and silver, to provide the versatility of being able to offer less expensive embodiments for casual use, as well as more expensive embodiments for career and formal use. Chain links or rings 6 could also comprise pearls, gemstones, and rhinestones. Decorative embellishments are contemplated for third preferred embodiment 26, and could include fringe, lace, appliqués, pearls, beads, sequins, gemstones, embroidery, rhinestones, small buttons, reflective decorations, decorative trim, and the like.

Figure 7:
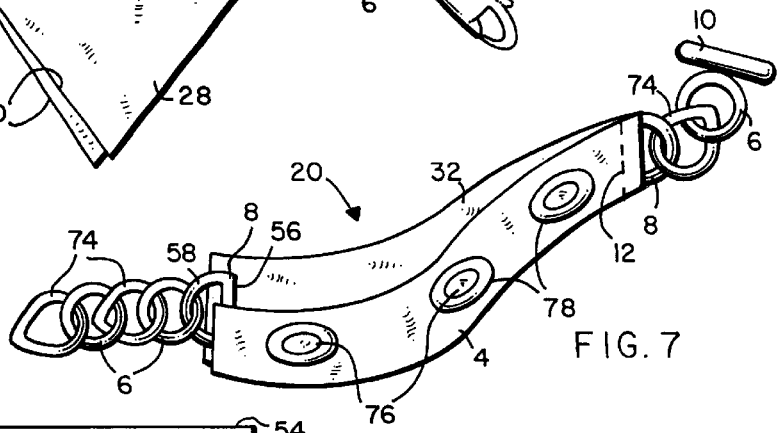
FIG. 7 is a front view of the second embodiment of the present invention having a scarf-like member with no dip and a lining, in a partially sewn configuration.

FIG. 7 shows a variation of second preferred embodiment 20 having one D-ring connector 8 attached to one end of scarf-like member 4 with a line of reinforcement stitching 12 that is approximately parallel to the end of scarf-like member 4, and a second D-ring connector 8 ready for stitching between scarf-like member 4 and a lining 32. It would be expected that once the second D-ring connector 8 is attached to scarf-like member 4, a second line of reinforcement stitching 12 would be placed adjacent to the newly attached D-ring connector 8 to strengthen the connection between it and scarf-like member 4. FIG. 7 also shows reflective decoration 76 attached to scarf-like member 4 and embroidery 78 surrounding each reflective decoration 76. A round chain link or ring 6 or an oval chain link 74 is attached to each D-ring connector 8, with more chain links or rings 6 and oval chain links 74 being attached to the D-ring connector 8 on the end of scarf-like member 4 opposed to toggle fastener 10, so that toggle fastener 10 during use can remain more centered on the back of a neck, similar to the position shown in FIG. 12. Although not limited thereto, chain links or rings 6 are shown in FIG. 7 in alternating attachment to the oval-shaped chain links 74. In addition, FIG. 7 shows the straight bar member 56 of the unattached D-ring connector 8 poised between scarf-like member 4 and lining 32. Although in FIG. 7 it is contemplated for scarf-like member 4 to comprise a single layer of fabric or material and for lining 32 to extend the full length of scarf-like member 4, it is equally contemplated for scarf-like member 4 to comprise more than one layer of fabric or material, and for lining 32 to be shorter in length dimension than scarf-like member 4 and centered on the back surface of scarf-like member 4 for contact only with the front of a wearer's neck. Also, although the lining 32 shown in FIG. 7 is stitched to scarf-like member 4 for permanent attachment thereto, it is also contemplated for lining 32 to be detachably connected to scarf-like member 4 with snaps, hook-and-pile fasteners, and other easily releasable fasteners that would not interfere with the comfortable use of the present invention. Toggle fastener 10 is configured to be blunt, for easy insertion and removal from the chain links or rings 6 and oval chain links 74, attached to the opposed end of scarf-like member 4, and for remaining flat against the wearer's neck during use, similar to the connection of toggle fastener 10 shown in FIG. 12 and 14. Should toggle fastener 10 be inserted into the first oval chain link 74 from the unattached D-ring connector 8 after it becomes secured between scarf-like member 4 and lining 32, the remaining distal chain link or ring 6 and remaining oval chain link 74 will hang vertically downward adjacent to toggle fastener 10, again similar to the position shown in FIGS. 12 and 14.

Figure 8:
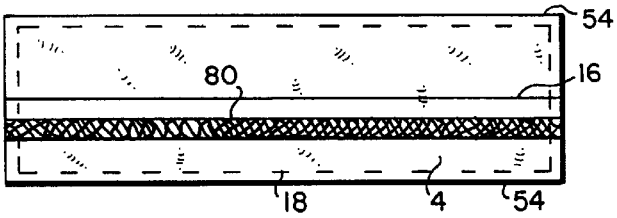
FIG. 8 is a front view of the material used for the second embodiment of the present invention having a scarf-like member with no dip, unfolded and in a ready-to-sew configuration.

FIG. 8 shows an example of the unfolded configuration of a scarf-like member 4 used for one-piece construction of the second embodiment 26 of the present invention. The upper and lower perimeter edges 54 of scarf-like member 4 are approximately parallel to one another, and no subtle dip 14 extends centrally upward or centrally downward from perimeter edges 54. FIG. 8 shows scarf-like member 4 having a central longitudinal fold line 16 with the quantity of fabric on each side of fold line 16 being approximately equal in size to and a mirror image of the other. FIG. 8 also shows a seam line 18 used for stitching the mirror image portions of scarf-like member 4 to one another after folding is achieved along fold line 16. In the most preferred embodiment, although not limited thereto, the seam line 18 is positioned between a minimum distance of approximately one-fourth of an inch and a maximum distance of approximately five-eighths of an inch from perimeter edges 54. Between fold line 16 and one of the seam lines 18, FIG. 8 shows an elongated piece of lace 80 attached longitudinally to scarf-like member 4 that extends substantially the full length of scarf-like member 4. Although not shown, depending upon the type of fabric used for scarf-like member 4, the stitching used for seam line 18 can comprise straight stitching, zig-zag stitching, or both, with zig-zag stitching being used for securing the easily unraveled edges in more delicate and loosely woven fabrics. As an alternative to one-piece construction, chain scarf invention 2 can be made from two pieces of fabric, each approximate in size to the fabric pieces that would result from cutting scarf-like member 4 along fold line 16. A third lining piece of fabric (not shown) could be added to give scarf-like member 4 a three-piece construction. The third piece of fabric could be used for support when gossamer fabrics are used for scarf-like member 4, or to provide color accent to embodiments of the present invention in which at least one of the pieces of scarf-like member 4 is partially transparent or sheer. The stitching of the folded halves of scarf-like member 4, subsequent to folding along fold line 16, can occur by more than one method. One such method can comprise the steps of placing together the right sides of scarf-like member 4, using thread (not shown) to stitch all of seam line 18 except a small section thereof, using the small unstitched section as an opening to turn scarf-like member 4 right-side-out, and then either placing top stitching over the small unstitched section close to seam line 18 to seal the opening, or in the alternative blind stitching the opening from the back side of scarf-like member 4 to close it. An alternative method for sewing together of the halves of scarf-like member 4, begins with folding scarf-like member 4 along fold line 16, with the right sides of scarf-like member 4 facing away from one another, creasing or ironing the edges of scarf-like member 4 along seam lines 18 so that perimeter edges 54 become positioned between the two halves of scarf-like member 4, and then using thread (not shown) to top stitch all four edges of scarf-like member 4 close to seam line 18. All methods of stitching the folded halves of scarf-like member 4 to one another would also include a step for the attachment of D-ring connectors or other similar jewelry-to-scarf connectors, such as rectangular-shaped connector 42, to the opposed ends of scarf-like member 4.

Figure 10:
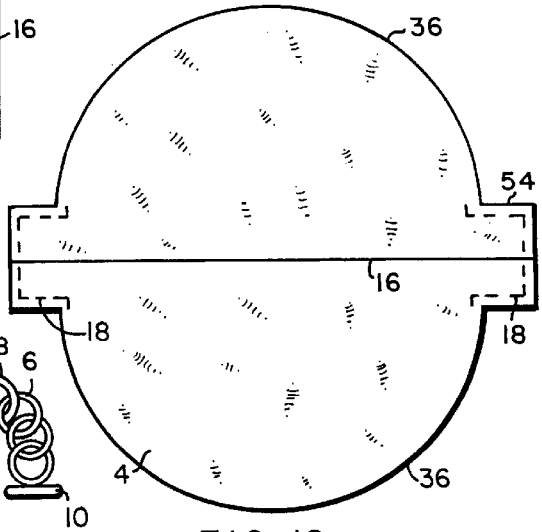
FIG. 10 is a top view of the material used for the scarf-like member in the fourth embodiment of the present invention, unfolded and in a ready-to-sew configuration.
Figure 9:
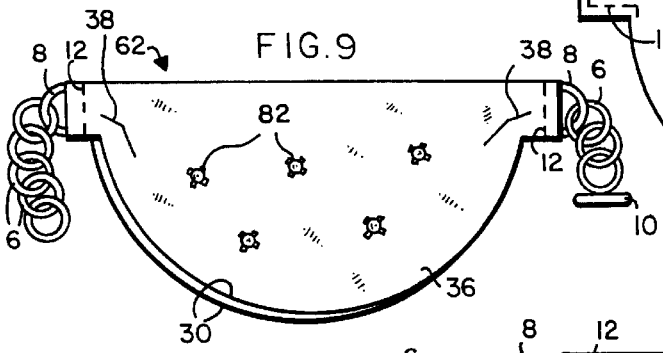
FIG. 9 is a back view of a fourth embodiment of the present invention having a scarf-like member with a cowl-shaped dip and a rolled hem, in a ready-to-wear configuration.

FIGS. 9 and 10 show a fourth preferred embodiment 62 of the present invention having an elongated scarf-like member 4 with a cowl-like dip 36. FIG. 9 shows scarf-like member 4 with a cowl-like dip 36 connected to a two-part jewelry member consisting of a longer segment of interconnected chain links or rings 6 attached to one end of scarf-like member 4 and a shorter second segment of interconnected chain links or rings 6 with a toggle fastener 10 attached to the other end of scarf-like member 4. FIG. 10 shows an example of the unfolded configuration of a scarf-like member 4 with a cowl-like dip 36 used for one-piece construction of fourth embodiment 62. In the alternative, a two-piece or three-piece construction of fourth embodiment 62, to produce two or three independently hanging cowl-like dips 36 layered on top of one another, is also considered to be within the scope of the present invention. In FIG. 10, cowl-like dips 36 that are approximately equivalent in size and near mirror images of one another, extend both centrally upward and centrally downward from scarf-like member 4 on opposing sides of fold line 16. FIG. 10 also shows opposed seam lines 18 near to the opposite ends of scarf-like member 4 where D-ring connectors 8 or other chain-to-scarf connectors would be attached to scarf-like member 4. In the fourth preferred embodiment 62, although not limited thereto, the seam line 18 is positioned between a minimum distance of approximately one-fourth of an inch and a maximum distance of approximately five-eighths of an inch from the perimeter edge 54 of scarf-like member 4. Although not shown, depending upon the type of fabric used for scarf-like member 4, the stitching used for seam line 18 can comprise straight stitching, zig-zag stitching, or both, with zig-zag stitching being used securing the easily unraveled edges in more delicate and loosely woven fabrics. Seam lines 18 allow the corresponding ends on both halves of scarf-like member 4 to be connected to one another along the lower edges of scarf-like member 4 between each D-ring connector 8 and cowl-like dip 36, for strengthening scarf-like member 4 adjacent to the attachment of D-ring connectors 8, as shown in FIG. 9. FIG. 9 also shows reinforcement stitching 12 in a position adjacent to each D-ring connector 8 for similar purposes. Further, as shown in both FIG. 9 and FIG. 10, it is contemplated that the two opposed cowl-like dips 36 will not be stitched together as no seam lines 18 appear near to perimeter edges 54 of the two opposed cowl-like dips 36. In FIG. 9 independent rolled hems 30 are indicated for the two opposed cowl-like dips 36 so that they can hang in a downward direction loosely and separately, one upon the other, to give the fourth embodiment a full and draped cowl-shaped appearance. FIG. 9 also shows the optional addition of lateral pleats 38 close to reinforcement stitching 12 on both ends of scarf-like member 4 for adding fullness to certain fabrics to create a more pleasing cowl-like appearance, as well as several spaced-apart rhinestones or gemstones 82 attached to scarf-like member 4. Any type of fastener allowing fourth embodiment 62 to be adjustably connected around a human neck is considered within the scope of the present invention and fourth embodiment 62 is not limited to the use of toggle fasteners 10 or lobster claw fasteners 60. Also in fourth preferred embodiment 62, the fastener or fasteners used would lay flat against the circumference of the neck and be configured to be blunt so as not to snag clothing or lay uncomfortably against the skin of the person wearing it. The additional chain links or rings 6 on the end of scarf-like member 4 remote from toggle fastener 10 would allow toggle fastener 10, or any other fasteners used, to become more centrally located on the back of most necks during use, for a balanced and more aesthetically pleasing appearance, similar to the position shown in FIG. 12. FIG. 9 further shows fourth embodiment 62 having a D-ring connector 8 attached to each end of scarf-like member 4 as a means of connecting chain links or rings 6 to scarf-like member 4. The use of D-ring connector 8 is not critical and it is contemplated for other chain-to-scarf connectors to be used, such as rectangular-shaped connector 42. Although not critical to the present invention, FIG. 9 shows the upper edge of scarf-like member 4 to have a substantially straight and unadorned configuration.

Although not shown in FIGS. 9 and 10, and not limited thereto, it is contemplated for fourth preferred embodiment 62 of the present invention to be made from thin, soft, and lightweight fabrics, although some medium weight fabrics would also be suitable. When fabrics and materials having a greater thickness dimension are used, and where necessary for the comfort of the person wearing it, a soft lining material, such as lining 32 shown in FIG. 7, could at least be attached to the central part of the neck-engaging back surface of scarf-like member 4 that is intended for contact with the front of a wearer's neck. Lining 32 could be permanently attached to scarf-like member 4, or detachably connected to it with easily manipulated fasteners (not shown), such as snaps or hook-and-loop fasteners. Although not limited thereto, in fourth preferred embodiment 62, the length dimension of scarf-like member 4 would be approximately eleven inches. The corresponding maximum height dimension of scarf-like member 4 would approximately six inches. Although other sizes of chain links or rings 6 are considered within the scope of the present invention, in the corresponding jewelry component it is preferred that chain links or rings 6 each have a width dimension of approximately three-fourths of an inch and for the longer connected segment of chain links or rings 6 to be approximately three inches in length. In fourth preferred embodiment 62, chain links or rings 6 and toggle fastener 10 would be made from gold, silver, a combination gold and silver, gold-filled materials, gold plated materials, silver plated materials and other non-tarnishing materials resembling gold and silver, to provide the versatility of being able to offer less expensive embodiments for career use, as well as more expensive embodiments for more formal occasions. It is also contemplated for chain links or rings 6 to comprise pearls, gemstones, and rhinestones. Decorative embellishments are contemplated for fourth preferred embodiment 62 as long as they are sufficiently small and lightweight so as not to weight down the fabric of scarf-like member 4 and destroy its cowl-like appearance, and such embellishments could include small appliques, beads, pearls, sequins, small buttons, small reflective decorations, embroidery, lace, decorative trim, and the like, and the small gemstones/rhinestones shown by the number 82.

Figure 11:
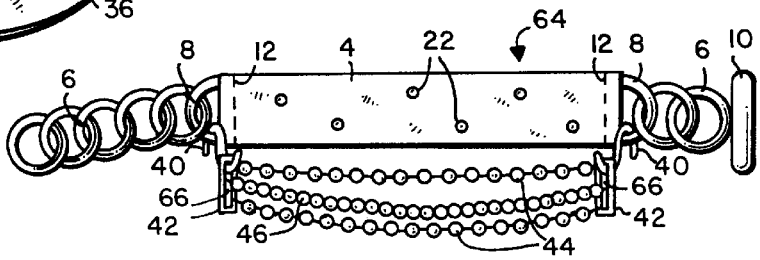
FIG. 11 is a front view of a fifth embodiment of the present invention having a scarf-like member with multiple chains connected to a rectangular-shaped connector that is detachably connected below the scarf-like member.

FIG. 11 shows a fifth preferred embodiment 64 of the present invention, similar to the second embodiment 20 in FIG. 5, with scarf-like member 4 having upper and lower edges that are approximately parallel to one another connected to a two-part jewelry member consisting of a longer segment of interconnected chain links or rings 6 attached to one end of scarf-like member 4 and a shorter second segment of interconnected chain links or rings 6 with a toggle fastener 10 attached to the other end of scarf-like member 4. FIG. 11 also shows a plurality of spaced-apart embellishments 22 attached to scarf-like member 4, and reinforcement stitching 12 on scarf-like member 4 near to each D-ring connector 8 for strengthening the ends of scarf-like member 4. In place of a subtle dip 14, a V-shaped dip 28, or a cowl-like dip 36, the fifth preferred embodiment 64 has two rows of beads or pearls 44 separated by a small chain segment 46, each detachably suspended below the lower edge of scarf-like member 4. While FIG. 11 shows three rows of embellishments, the center row thereof consisting of chain links 46, and the top and bottom rows consisting of beads or pearls 44, with each row being connected on both of its ends to a rectangular-shaped connector 42 via small spaced-apart openings 48 therein, the number of rows of beads or pearls 44 and small chain segments 46 and the configuration of rectangular-shaped connectors 42 are not critical to the present invention. Further, the attachment of the rows of beads or pearls 44 and small chain segments 46 to rectangular-shaped connector 42 via small openings 48 is not critical and it is equally contemplated that the connection of the rows of beads or pearls 44 and small chain segments 46 to rectangular-shaped connector 42 be established through rectangular opening 66. Therefore, although not shown, it is considered to within the scope of the present invention for the fifth embodiment 64 to have any number of rows of beads or pearls 44 and small chain segments 46 suspended below scarf-like member 4, for the sizes of the beads or pearls 44 and small chain segments 46 suspended below scarf-like member 4 to be variable such as but not limited to alternating rows of small and large beads or pearls 44 and small chain segments 46 as well as beads or pearls 44 and small chain segments 46 of differing sizes within a single row, and for the devices holding the ends of the rows of beads or pearls 44 and small chain segments 46 to have configurations other than rectangular. Also, although FIG. 11 shows beads or pearls 44 and small chain segments 46 in any array that is easily detachable from scarf-like member 4 through the use of S-shaped hooks 40, it is equally contemplated by the fifth embodiment 64 for beads or pearls 44 and small chain segments 46 to be permanently connected to scarf-like member 4 or the jewelry component attached to scarf-like member 4, with or without S-shaped hooks 40 and rectangular-shaped connectors 42. Also in detachable embodiments, the means of detachable connection is not limited to the S-shaped hooks 40 shown in FIG. 11 being inserted through the rectangular openings 66 in rectangular-shaped connectors 42, and other obvious, well known, and commonly used jewelry means for temporarily securing beads or pearls 44 and small chain segments 46 below a scarf-like member 4 are also considered to be within the scope of the present invention without specific reference thereto. Further, FIG. 1 shows scarf-like member 4 in fifth embodiment 64 having bead-like decorative embellishments 22 in addition to beads or pearls 44 and small chain segments 46, however, it is also contemplated for fifth embodiment 64 to have other embellishments, such as but not limited to appliques, gemstones, rhinestones, small buttons, sequins, embroidery, reflective decorations, lace, fringe, and the like. Also, although the upper edge of scarf-like member 4 is shown in FIG. 11 to be substantially straight and unadorned, it is equally contemplated for such upper edge to have aesthetically pleasing arcuate or angled configurations. Further, as with most of the other embodiments of the present invention, it is contemplated for fifth preferred embodiment 64 to be made from both very expensive and less expensive jewelry components to offer differing product lines for formal, career, and casual applications.

Figure 12:
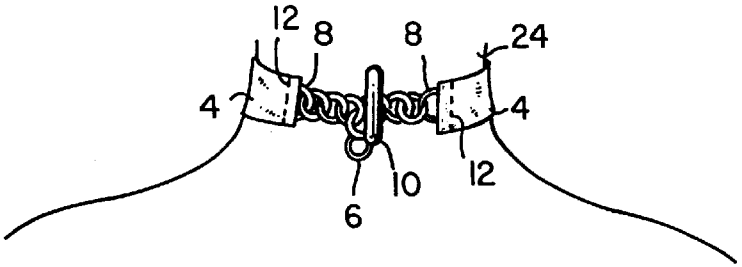
FIG. 12 is a back view of the present invention shown on a neck, with D-ring connectors and a single-point chain/toggle connection.

FIG. 12 shows the present invention secured around a human neck 24, with D-ring connectors 8 attached to the opposing ends of scarf-like member 4 which remain at a spaced-apart distance from one another against neck 24. Reinforcement stitching 12 is positioned adjacent to each end of scarf-like member 4 to strengthen it. In most preferred embodiments it is contemplated for the spaced-apart distance between the opposing ends of scarf-like member 4 during use to be between approximately two-and-one-half inches and three inches for the maximum comfort of the wearer, as well as for the most aesthetically pleasing appearance against the back of neck 24. FIG. 12 also shows each D-ring connector 8 attached to a two-part jewelry component mainly comprising large chain links or rings 6 nearly as wide as the height dimension of the opposing ends of scarf-like member 4 to which it is connected. Although such large width dimension is preferred in chain links or rings 6, their size is not critical and it is also contemplated for two or more smaller two-part jewelry components, similar to that shown in FIG. 12, to be attached to each opposing end of a single scarf-like member 4. In each preferred two-part jewelry component, one jewelry part would comprise a longer segment of chain links or rings 6, typically having a minimum of five chain links or rings 6, with the second jewelry part being shorter and comprising a minimum of two or three chain links or rings 6 as well as a fastener, such as toggle fastener 10, attached to the distal chain link or ring 6. Although FIG. 12 shows toggle fastener 10 connected though the middle chain link or ring 6 in the opposing longer segment of chain links or rings 6, it is contemplated for toggle fastener 10 to be inserted through any of the opposing chain links or rings 6 that would cause scarf-like member 4 to become securely fixed into its usable position, to provide an adjustable connection between the opposing ends of scarf-like member 4, with a correspondingly greater or smaller number of chain links or rings 6 hanging in a downwardly direction against the central portion of neck 24 as differently positioned chain links or rings 6 become engaged with toggle fastener 10. For a more extended and dramatic look on the back of neck 24, similar to that shown in FIG. 14, it is contemplated for the longer segment of chain links or rings 6 to optionally have an additional two or three chain links or rings 6 beyond that shown in FIG. 12.

FIGS. 13, 14, and 15 show an alternative means to the one illustrated in FIG. 12 for securing the opposing ends of scarf-like members 4 made from bulkier materials or having a larger height dimension into their usable positions against a neck 24, with FIG. 15 showing a three-point connection of chain links or rings 6 to a rectangular-shaped connector 42 in lieu of the two-point connection shown in FIGS. 13 and 14. FIGS. 13, 14, and 15 each show more than one small chain segment 46 connected between chain links or rings 6 and a rectangular-shaped connector 42 used in place of a D-ring connector 8 for providing a chain-to-scarf connection. FIG. 13 shows an enlarged view of the attachment of rectangular-shaped connector 42 to scarf-like member 4 with one of the longer sides of rectangular-shaped connector 42 hidden beneath and stitched securely within the opposing folded layers of scarf-like member 4, similar to the manner in which the straight bar member 56 of D-ring connector 8 is attached to scarf-like member 4 in the first embodiment 2 of the present invention with subtle dip 14, as shown in FIGS. 3 and 4. The steps of attachment would be similar to that used for D-ring connector 8 in FIGS. 3 and 4, with a line of reinforcement stitching 12 extending the full height of scarf-like member 4 and being positioned adjacent to rectangular-shaped connector 42 to help strengthen the end of scarf-like member 4 and also to help maintain rectangular-shaped connector 42 in an optimal position during use with a maximum amount of rectangular-shaped connector 42 continuously projected beyond the end of scarf-like member 4. FIG. 13 further shows several spaced-apart small buttons 84 attached to scarf-like member 4 and used for decoration, as well as several spaced-apart small holes 48 for use in connecting the small chain segments 46 to rectangular-shaped connector 42, however, it is also considered within the scope of the present invention for small chain segments 46 to alternatively be attached to rectangular-shaped connector 42 through it central opening 66, or via other obvious, well-known, and commonly used jewelry means, without specific reference thereto. Although it is conceivable that the connection of small chain segments 46 to rectangular-shaped connectors 42 could be detachable for the exchange of the jewelry component connecting the ends of scarf-like member 4 for a second jewelry component having a different composition of chain links, beads, or pearls 44, or a different design, for most purposes the connection of small chain segments 46 to rectangular-shaped connectors 42 would be a permanent one. FIG. 14 shows the appearance of the present invention comprising rectangular-shaped connectors 42 against the back of a neck 24. One segment of large chain links or rings 6 would be longer that the opposing segment of large chain links or rings 6 so that toggle fastener 10, or other quick-release flat fastener, such as lobster claw fastener 60, would be approximately centered against the back of neck 24 in a position that is aesthetically pleasing to a viewer (not shown). FIG. 15 shows three small chain segments 46 each attached to a rectangular-shaped connector 42 via small openings 48. Although all three small chain segments 46 are connected to a single chain link or ring 6, it is contemplated for one or more of the lateral small chain segments 46 to be attached to a different chain link or ring 6, for additional variation in decorative design.

Figure 16:
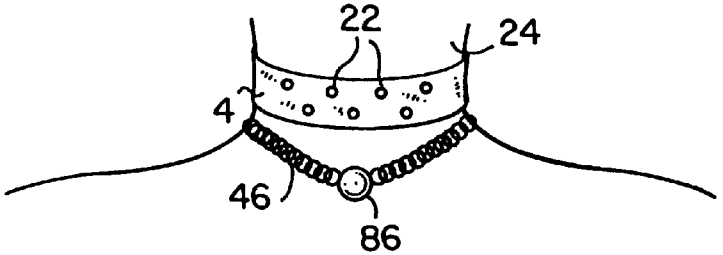
FIG. 16 is a front view of the second embodiment with pearl/bead embellishment, shown in its usable position on a neck.
Figure 18:
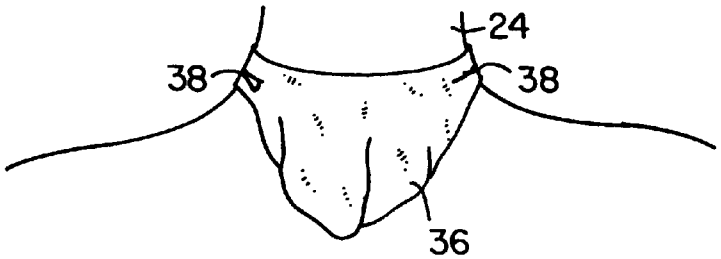
FIG. 18 is a front view of the fourth embodiment with pleats, shown in its usable position on a neck.

FIGS. 16, 17, 18, and 19 all show the present invention connected around the front of a human neck 24. FIG. 16 shows the second embodiment 20 with an array of pearl/bead-like decorative embellishments 22 attached to scarf-like member 4. Although FIG. 16 shows scarf-like member 4 connected around the lower part of a neck 24, it is also contemplated for scarf-like member 4 in second embodiment 20 to be connected in a position higher than shown, more toward the middle part of neck 24. FIG. 16 also shows a medallion 86 connected to small chain 46. It is contemplated that the hidden ends of small chain 46 would be attached to scarf-like member 4 in a manner similar to that shown in FIG. 11, through use of s-hooks 40 connected to D-connector 8, or the square connectors 42 shown in FIGS. 13–15. FIG. 17 shows the first embodiment 20 with a crest/shield embellishment 50 attached in an offset manner relative to the center front surface of scarf-like member 4, and a small chain segment 46 attached to crest/shield embellishment 50. FIG. 17 shows scarf-like member 4 with subtle dip 14 connected in a higher position around neck 24 than is shown for the second embodiment 20 in FIG. 16. FIG. 18 shows the fourth embodiment 62 having a scarf-like member 4 with a centered cowl-like dip 36 and lateral pleats 38 to enhance the fullness and cowl-shaped appearance of scarf-like member 4. It is contemplated that the fourth embodiment 62 could be used equally well around the middle or lower portions of neck 24, as needed to successfully complete a fashion statement. FIG. 19 shows the third embodiment 26 of the present invention having a V-shaped dip 28, a teardrop-shaped embellishment 52 such as a gemstone attached to V-shaped dip 28 at the lowest point of its V-shaped configuration, and a quantity of fringe 68 connected to the lower edge of V-shaped dip 28 on both sides of teardrop-shaped embellishment 52. If V-shaped dip 28 would consist of two fabric layers, as shown in FIG. 6, fringe 68 could be attached to the lower edges of one or both such layers. FIG. 19 shows scarf-like member 4 connected in a position around the lower portion of neck 24, where it would most likely be used.

To wear the present invention as a fashion accessory, one would select an embodiment having scarf-like member 4 made from fabric or material appropriate to the style of clothing to be worn therewith, either formal wear, casual wear, or career oriented fashions. Then one would select an embodiment having scarf-like member 4 with a configuration appropriate to the style of clothing chosen for use, either first embodiment 2 having a subtle dip 14, second embodiment 20 having no dip, third embodiment 26 having a V-shaped dip 28, or fourth embodiment 62 having a cowl-like dip 36. The next selection would be to provide a scarf-like member 4 with colors that either complement or create a color accent for the casual garments or fashion ensemble chosen for use. To further customize the present invention for use, detachable decorative embellishments 22 can be added, including teardrop-shaped embellishments 52, fringe 68, multiple rows of chain links, beads, or pearls 44 configured to hang below scarf-like member 4, and appliques or crest/shield embellishments 50 optionally attached to scarf-like member 4 with hook-and-loop fasteners (not shown). If a soft detachable lining 32 is needed for the comfort of the person wearing the present invention, a lining 32 made from soft fabric such as silk could be added to the entire back surface of scarf-like member 4, or only a portion of it, with snaps or hook-and-loop fasteners. Then, once the selected scarf-like member 4 is amply embellished and ready for use, the wearer or someone assisting the wearer would grasp each of the opposing segments of chain links or rings 6 with a different hand and draw chain links or rings 6 around to the back of the wearer's neck 24 while centering scarf-like member 4 against the front of neck 24, and fastening the opposing segment of chain links or rings 6 to one another so as to securely fix scarf-like means 4 against neck 24. The position of scarf-like member 4 could be low on neck 24, or higher toward the middle part of neck 24. The distal ends of each segment of chain links or rings 6 would be drawn around to the back of neck 24, with the ends of scarf-like member 4 ideally remaining at a spaced-apart distance from one another of approximately two to three inches. Thereafter, the fastener positioned at the end of the shorter segment of chain links or rings 6, such as toggle fastener 10 or lobster claw fastener 60, would be used to engage an appropriate chain link or ring 6 on the longer segment of chain links or rings 6 to comfortably secure scarf-like member 4 into its usable position against the front of neck 24 without the wearer experiencing unpleasant neck constriction, or choking and gagging sensations. To remove the present invention from neck 24, one would simply disengage the fastener positioned at the end of the shorter segment of chain links or rings 6 from the connecting chain link or ring 6 on the longer segment of chain links or rings 6 and gravity would cause the present invention to fall away from neck 24. It is intended that the materials selected for scarf-like member 4 and the jewelry portion comprising two segments of chain links or rings 6 would keep after use maintenance of the present invention to a minimum. Chain links or rings 6, as well as the fasteners securing them to one another such as toggle fastener 10 or lobster claw fastener 60, would be made from tarnish-free materials. Also, the scarf-like members 4 used for casual embodiments would be made from fabrics and materials that can be easily cleaned, or in the alternative have a detachable lining 32 that can be cleaned between uses.

To manufacture the first embodiment of the present invention, one would first provide a scarf-like member 4. For one-piece construction, the piece of fabric or other material provided for scarf-like member 4 would be approximately double and slightly larger than the intended length and height dimensions of the assembled scarf-like member 4. Once folded in half along a central longitudinal fold line 16, the fabric or other material used to make scarf-like member 4 would begin to resemble the ready-to-use configuration. One preferred method for attaching the fabric or other material used for scarf-like member 4 to the two-part jewelry component comprising chain links or rings 6, would involve the placement of the right sides of the fabric or other material against one another with the two-part jewelry component therebetween, with at least one D-ring connector 8 extending beyond each of the ends of scarf-like member 4, as shown in FIG. 4. After thread (not shown) is placed along seam line 18 to seal and secure the folded halves of scarf-like member 4 to one another at its opposing ends, scarf-like member 4 is turned right-side-out. If seam lines 18 extend along the entire perimeter of scarf-like member 4, a small opening would be left for turning scarf-like member 4 right-side-out, after which the small opening would be sealed with a short segment of reinforcement stitching 12 preferably on the lateral lower edge of scarf-like member 4, such as shown in FIG. 1. Also, once scarf-like member 4 is turned right-side-out, a line of reinforcement stitching 12 extending the full height of each opposing end of scarf-like member 4 is preferably added to scarf-like member 4 adjacent to D-ring connectors 8, to strengthen scarf-like member 4 during use. If scarf-like member 4 is made from a one-piece construction and its lower edges are not stitched to one another, such as in the third embodiment having a V-shaped dip 28 and the fourth embodiment having a cowl-like dip 36, the lower edges would be kept from unraveling by rolling and securing each of them individually and separately into a rolled hem 30. Decorative embellishments 22 can be added to the exposed surface of scarf-like member 4, prior to folding and the attachment of chain links and rings 6, or after their attachment, as needed for most efficient assembly. For two-piece or three-piece construction of scarf-like member 4, several options are possible. A single layer of material can be attached to an identically configured lining 32 of soft fabric such as silk, positioned with right sides together and opposing jewelry components therebetween, stitched along seam lines 18 while leaving a small opening available for turning scarf-like member 4 right-side-out, followed by scarf-like member 4 being turned right-side-out so that lining 32 completely covers the back surface of scarf-like member 4. In the alternative, a lining 32 having the same perimeter dimension or a perimeter dimension smaller than that of a scarf-like member 4 can be added to the hidden surface of a two-layer scarf-like member 4 already secured to its complementary jewelry portion comprising chain links and rings 6. Further, when scarf-like member 4 is made from two layers of sheer fabric or material, a third layer can be placed between them for additional support and/or color contrast or accent, the third layer most likely being added during the step of connecting the jewelry component to scarf-like member 4.

What is claimed is:

1. A clothing accessory for decorating a human neck that can be worn comfortably for extended periods of time while in a fixed position closely held against the neck, said fashion accessory comprising:

elongated flexible scarf-like means with opposed ends, said scarf-like means being adapted for partially encircling a human neck; and jewelry means connected to said opposed ends, said jewelry means being adapted for securely holding said scarf-like means against a human neck so that said scarf-like means remains in an initially selected position on the neck during use.

2. The clothing accessory of claim 1 wherein said scarf-like means further comprises at least one soft neck-engaging surface adapted for contact with the front of a human neck.

3. The clothing accessory of claim 2 wherein said soft neck-engaging surface is selected from a group consisting of permanently attached linings and detachable linings.

4. The clothing accessory of claim 1 wherein said scarf-like means further comprises a lower dip.

5. The clothing accessory of claim 4 wherein said dip is selected from a group consisting of slightly convex dips having a configuration adapted for subtly following the curvature of a human neck, cowl-like dips, and V-shaped dips.

6. The clothing accessory of claim 1 wherein said scarf-like means comprises materials selected from a group consisting of silk, polyester, linen, rayon, chiffon, cashmere, faux fur, wool, suede, leather, denim, velvet, quilted materials, and mink.

7. The clothing accessory of claim 1 wherein said scarf-like means has maximum length and height dimensions of approximately eleven inches and six inches, respectively.

8. The clothing accessory of claim 1 further comprising at least one decorative embellishment connected to said scarf-like means.

9. The clothing accessory of claim 8 wherein each said embellishment is selected from a group consisting of beads, pearls, sequins, gemstones, rhinestones, small buttons, embroidery, appliques, patches, reflective devices, fringe, lace, medallions, shields, crests, small chains, teardrop-shaped objects, and decorative trim.

10. The clothing accessory of claim 1 wherein said jewelry means comprises materials selected from a group consisting of gold, silver, pearls, gemstones, rhinestones, gold-filled materials, gold-plated materials, silver-plated materials, and non-tarnishing materials resembling gold and silver.

11. The clothing accessory of claim 1 wherein said jewelry means comprises components selected from large circular chain links, small circular chain links, oval chain links, elongated chain links, D-ring connectors, rectangular-shaped connectors having an opening therethrough and a plurality of small spaced-apart holes, toggle fasteners, lobster claw type fasteners, and blunt fasteners with configurations adapted for laying flat against a neck.

12. The clothing accessory of claim 1 wherein said jewelry means comprises an adjustable fastening means.

13. The clothing accessory of claim 12 wherein said adjustable fastening means comprises a longer chain segment and a shorter chain segment, with a toggle fastener connected to said shorter chain segment.

14. A clothing accessory for decorating a human neck that can be worn comfortably while positioned closely against the neck, said fashion accessory comprising:

elongated flexible scarf-like means with opposed ends and being adapted for partially encircling a human neck as well as soft contact with the front of the neck; and elongated jewelry means connected to said opposed ends and being adapted for easy length-adjustability and securely fastening said scarf-like means against a human neck so that said scarf-like means remains in an initially selected position throughout use.

15. A method for manufacturing a chain-scarf clothing accessory that is used for decorating a human neck and which can be worn comfortably while in a position closely against the neck that allows said accessory to remain in an initially selected position throughout use, said method comprising the steps of:

providing a plurality of elongated scarf-like members each with opposed ends, a length dimension sufficient to partially encircle a human neck, an exposed surface, a neck engaging surface, and a perimeter dimension slightly greater than twice that desired when said scarf-like member is ready for use, at least one fabric member having a length dimension sufficient to partially encircle a human neck and a perimeter dimension slightly greater than that desired when said scarf-like member is ready for use, a plurality of elongated jewelry members having different length dimensions, a plurality of jewelry fasteners adapted to lay flat during use, a plurality of linings made from soft fabric, and a plurality of decorative embellishments;

selecting one of said scarf-like members having a perimeter dimension slightly greater than twice that desired when said scarf-like member is ready for use;

folding said selected scarf-like member approximately in half so that said exposed surface and said neck engaging surface face one another;

selecting two of said chain-like jewelry members attaching one of said jewelry members to each of said opposed ends of said first scarf-like member;

optionally selecting a second one of said scarf-like members;

optionally adding at least one of said decorative embellishments to said exposed surface of said scarf-like member; and optionally adding at least one of said linings to said neck engaging surface of said scarf member.

16. The method of claim 15 wherein said scarf-like means comprises materials selected from a group consisting of silk, polyester, linen, rayon, chiffon, cashmere, faux fur, wool, suede, leather, denim, velvet, quilted materials, and mink.

17. The method of claim 15 wherein said embellishments are selected from a group consisting of beads, pearls, sequins, gemstones, rhinestones, small buttons, embroidery, appliqués, patches, reflective devices, fringe, lace, medallions, shields, crests, small chains, teardrop-shaped objects, and decorative trim.

18. The method of claim 15 wherein said jewelry members comprise materials selected from a group consisting of gold, silver, pearls, gemstones, rhinestones, gold-filled materials, gold-plated materials, silver-plated materials, and non-tarnishing materials resembling gold and silver.

19. The method of claim 15 wherein said scarf-like members each have a configuration selected from a group consisting of convexly-shaped subtle dips having a configuration adapted for subtly following the curvature of a human neck, cowl-like dips, and V-shaped dips.

20. The method of claim 15 wherein said jewelry members are selected from a group consisting of large circular chain links, small circular chain links, oval chain links, elongated chain links, D-ring connectors, rectangular-shaped connectors having an opening therethrough and a plurality of small spaced-apart holes, toggle fasteners, lobster claw type fasteners, and blunt fasteners with configurations adapted for laying flat against a neck.

* * * * *